United States Patent [19]

Merbler

[11] Patent Number: 4,596,396

[45] Date of Patent: Jun. 24, 1986

[54] ROLLER SKATE

[76] Inventor: Rudolph Merbler, 108 Brentwood, Fairport, N.Y. 14450

[21] Appl. No.: 553,842

[22] Filed: Nov. 21, 1983

[51] Int. Cl.[4] ..... A63C 17/02

[52] U.S. Cl. ..... 280/11.28; 280/11.3

[58] Field of Search ..... 280/11.28, 11.3, 11.19, 280/11.2, 11.27, 1 R, 633, 636

[56] References Cited

U.S. PATENT DOCUMENTS

| | | | |
|---|---|---|---|
| 2,502,153 | 3/1950 | Jack | 280/11.28 |
| 2,578,911 | 12/1951 | Van Horn | 280/11.8 |
| 2,722,429 | 11/1955 | Merbler | 280/11.28 |
| 2,822,182 | 2/1958 | Merbler | 280/11.28 |
| 2,937,031 | 5/1960 | Hartley et al. | 280/11.2 |
| 3,043,600 | 7/1962 | Voakes | 280/11.3 |
| 3,180,651 | 4/1965 | Ware | 280/11.2 |
| 3,653,678 | 4/1972 | Collett | 280/11.28 |
| 3,675,938 | 7/1972 | Sigl | 280/636 |
| 3,774,924 | 11/1973 | Machatsch | 280/11.28 |
| 3,865,441 | 2/1975 | Jolliffe | 305/54 |
| 3,895,844 | 7/1975 | Merbler | 301/5.7 |
| 4,141,570 | 2/1979 | Sudmeier | 280/633 |
| 4,311,319 | 1/1982 | Snyder et al. | 280/11.28 |

FOREIGN PATENT DOCUMENTS

| | | | |
|---|---|---|---|
| 1175129 | 7/1964 | Fed. Rep. of Germany | 280/11.2 |

*Primary Examiner*—David M. Mitchell
*Assistant Examiner*—Eric Culbreth
*Attorney, Agent, or Firm*—Stuart O. Lowry

[57] ABSTRACT

A one-piece hanger plate is detachably secured to the underside of a shoe plate for a roller skate. Front and rear wheel trucks are mounted to the hanger plate independent of the shoe plate. The hanger plate is constructed with bends to provide strength against twisting of the shoe plate and hold the front and rear wheel trucks in proper alignment. A unique king pin elastomer mounting for each wheel truck permits adjustment of the degree of firmness. A toe stop is designed to be detachable from the shoe plate so that the roller skate can be lightened for certain skating activities.

5 Claims, 3 Drawing Figures

ROLLER SKATE

FIELD OF THE INVENTION

This invention relates generally to roller skates and more particularly to an improved roller skate shoe plate and hanger plate construction.

BACKGROUND OF THE INVENTION

In my prior U.S. Pat. No. 3,895,844, I describe an improved roller skate wheel. In my prior U.S. Pat. Nos. 2,722,429 and 2,822,182 there are shown bearing mountings for roller skate trucks. Hanger plates for roller skate shoe plates are known generally in the art and usually take the form of separate hangers for the front and rear wheel trucks. Primarily, these hanger plates offer resilience and allegedly serve to absorb shocks and the like. An example of such hanger plate is shown in U.S. Pat. No. 3,774,924. Still some other hanger plate designs serve to partially support the wheel truck, the remaining portion of the wheel truck being secured to the roller skate shoe plate. An example of this latter construction is shown in U.S. Pat. No. 865,441.

Despite the foregoing known art, there is still room for improvement in roller skate hanger plate and wheel truck construction. More particularly, a desirable feature would be some means for enabling the wheel trucks to be readily removed and replaced by other wheel trucks using the same shoe plate so that a skater could readily convert his or her roller skates to different types of rollers and supports for the rollers without having to use a different shoe plate. In addition, it is desirable for figure skating and certain other skating activities to construct roller skates to be as light as possible and yet strong enough to withstand the severe strains to which they are subject, particularly in dancing and sports.

Still another desirable feature would be to provide simple yet reliable means for adjusting the height of each roller skate; that is, the distance between the shoe plate and the wheel trucks. By providing for individual adjustment, a pair of skates can be custom adapted to a particular skater wherein there may be a problem with balance as a consequence of one of the skater's legs being shorter than the other.

BRIEF DESCRIPTION OF THE PRESENT INVENTION

With the foregoing in mind, the present invention contemplates the provision of a greatly improved combination shoe plate and hanger plate wherein many of the foregoing special needs are fully realized.

More particularly, in its broadest aspect, the roller skate of this invention includes, in combination, a shoe plate; a one piece hanger plate secured to the shoe plate at points adjacent to the opposite ends of the hanger plate, the central section of the hanger plate between its points of attachment to the shoe plate being spaced from the underside of the shoe plate; and, front and rear wheel trucks connected to the hanger plate on either side of the central section, independent of the shoe plate. Appropriate bends in the hanger plate defining the central section provide great strength in the plate itself against possible misalignment of the front and rear wheel trucks secured to the plate. Because the wheel trucks are secured to the hanger plate independently of the shoe plate, it is a simple matter to exchange one hanger plate and set of wheel trucks for another, using the same shoe plate.

BRIEF DESCRIPTION OF THE DRAWINGS

A better understanding of this invention as well as many further features and advantages thereof will be had by now referring to a preferred embodiment thereof as illustrated in the accompanying drawings in which.

DETAILED DESCRIPTION OF THE PREFERRED EMBODIMENT

Figure 1:
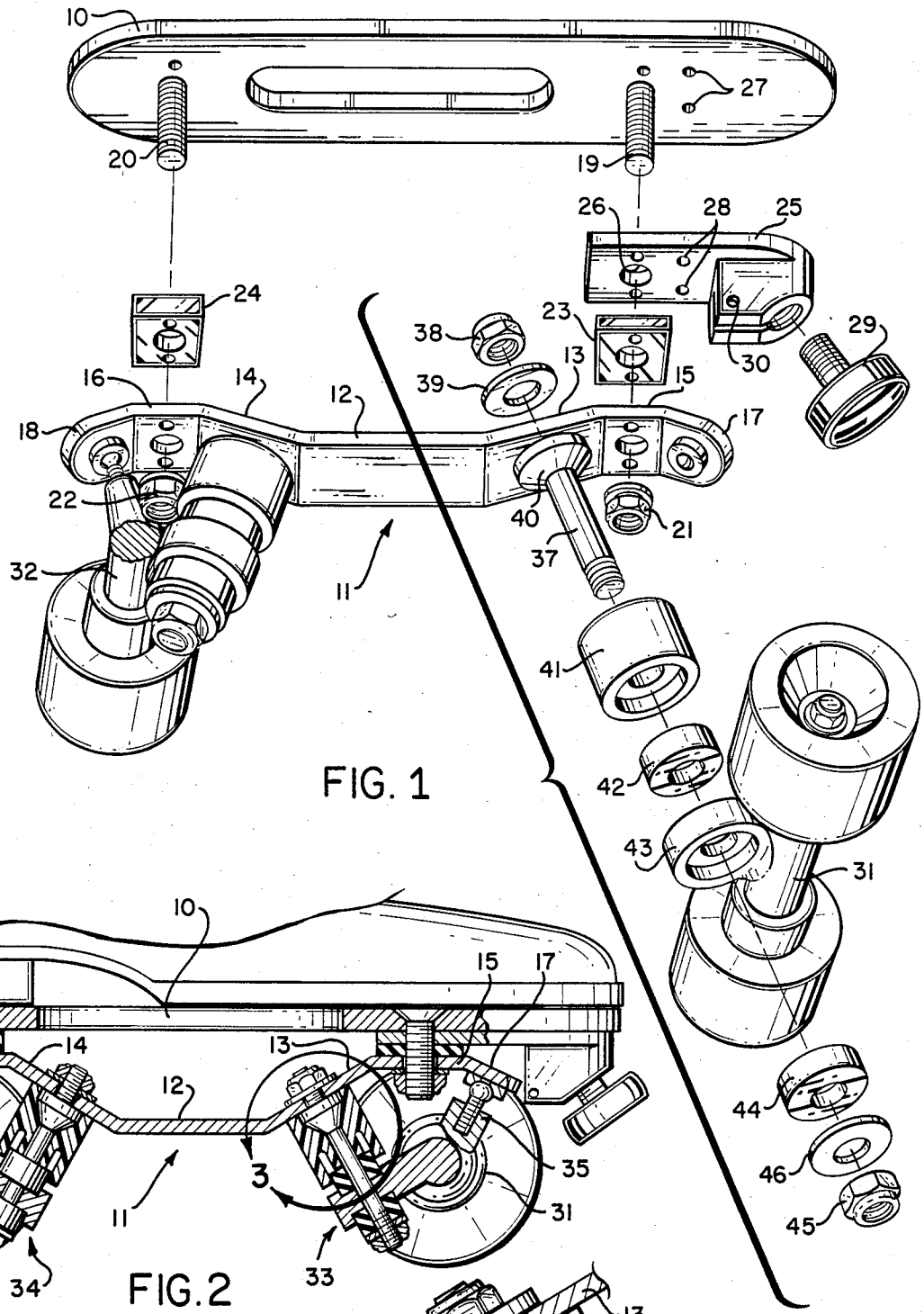
FIG. 1 is an exploded perspective view cut away at certain areas of a roller skate in accord with the present invention.

Referring to the upper portion of FIG. 1, there is shown a shoe plate 10 for cooperation with a hanger plate shown in the central portion of FIG. 1 and designated generally by the numeral 11.

The hanger plate 11 constitutes a one piece integral member having a flat central section 12 merging into front and rear upwardly sloping intermediate sections 13 and 14. Intermediate sections 13 and 14, in turn, merge into front and rear flat intermediate sections 15 and 16, respectively. The flat intermediate sections terminate in front and rear downwardly sloping end sections 17 and 18 respectively. A "truss" like structure results, providing for great strength against misalignment of the front and rear ends.

Referring once again to the shoe plate 10, there are shown front and rear detachable securing means including threaded studs 19 and 20 for cooperation with appropriate nuts 21 and 22 shown exploded below appropriate aligned openings in the intermediate flat sections 15 and 16 of the hanger plate 11.

The remaining sections of the hanger plate are free of engagement with the shoe plate when the detachable securing means are in place, these being the sole attachment means to the shoe plate. Appropriate spacers illustrated at 23 and 24, are positionable between the intermediate flat sections 15 and 16 in the underside of the shoe plate 10 to adjust the level of the hanger plate 11 with respect to the plane of the shoe plate 10.

Referring to the upper right hand portion of FIG. 1, there is shown a desirable feature of this invention in the form of a front toe stop supporting plate 25 having an opening 26 which cooperates with the detachable securing means for the front end of the hanger plate 11; that is, the same receives the threaded stud 19. This rear portion of the supporting plate 25 is thus secured to the underside of the shoe plate by the same stud 19 used for the front portion of the hanger plate. In the example illustrated, the rear portion of the supporting plate 25 also functions as a spacer cooperating with the spacer 23 to provide an overall spacing distance equal to the spacer 24 for the rear attachment of the hanger plate.

Additional detachable means are also provided for the supporting plate 25 in the form of aligned openings 27 in the shoe plate 10 and tapped openings 28 in the supporting plate 25 for receiving appropriate screws.

The toe stop itself is illustrated at 29 and is received in the supporting plate structure 25 and appropriately locked in position as by a set screw 30.

The foregoing described arrangement permits easy removal of the supporting plate 25 and toe stop 29 when it is desired to lighten the skate and provide greater freedom for special types of skating activities.

Figure 2:
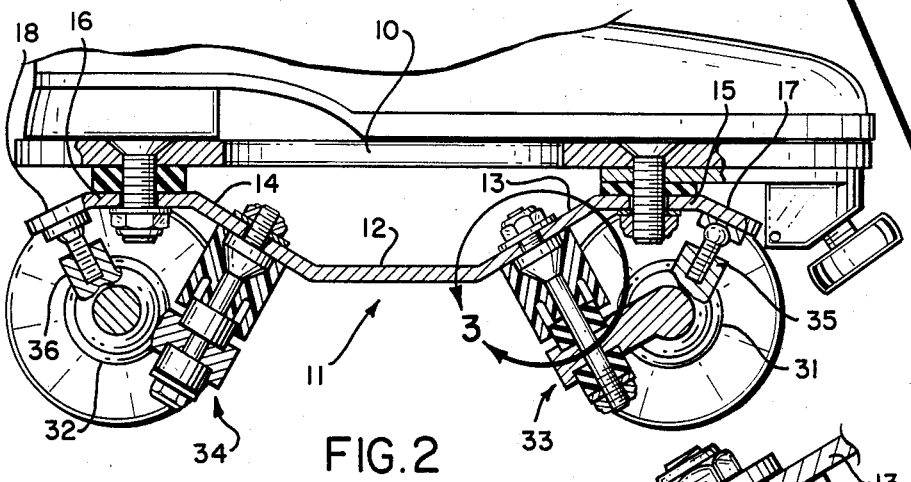
FIG. 2 is a side cross section of the roller skate of FIG. 1 in assembled relationship; and, FIG. 3 is an enlarged fragmentary cross section of certain stucture enclosed within the circular arrow 3 of FIG. 2.

Referring now momentarily to FIG. 2, there are shown front and rear wheel trucks 31 and 32 and cooperating front and rear king pin and elastomer cushioning means 33 and 34 and cooperating front and rear pivot bushing assemblies 35 and 36 extending from the front and rear wheel trucks towards the underside of the front and rear downwardly sloping end sections 17 and 18 of the hanger plate 11.

The front and rear wheel trucks, cooperating king pin and elastomer bushing means and pivot assemblies are the same and therefore a detailed description of the front truck, kingpin assembly and pivot assembly will suffice also for the rear.

Accordingly, and referring back to the exploded view of FIG. 1, the kingpin for the front truck includes a stud bolt 37 arranged to be secured to the upwardly sloping intermediate section 13 of the hanger plate 11 as by an appropriate nut 38 and cooperating washer 39. A conical bushing 40 is shown at the underside of the upwardly sloping section 13 of the hanger plate surrounding the stud bolt 37. This conical bushing is arranged to seat a cushion adapter 41 against the underside of the upwardly sloping intermediate section 13. A first elastomer bushing 42, in turn, is received about the end of the stud bolt 37 to seat against the cushion adapter 41. Front wheel truck 31 includes a truck eye 43 axially aligned with the stud bolt 37 and receivable against the first elastomer bushing 42. The inside diameter of the eye 43 is greater than the outside diameter of the stud bolt 37 so that a slight degree of universal movement of the wheel truck 31 is possible.

A second elastomer bushing 44 is receivable over the stud bolt 37 to sandwich the eye 43 with the first elastomer bushing 42. An appropriate end nut 45 and washer 46 after being received on the stud bolt 37 will hold the assembled parts together as illustrated in FIG. 2.

It is to be appreciated that the first and second elastomer bushings 42 and 44 accommodate the limited universal movement of which the truck 31 is capable in view of the larger diameter of the eye 43 than the stud bolt 37. This elastomer type mounting is very desirable. The limited movement involved is stabilized by the pivot assembly designated generally at 35 in FIG. 2.

It is to be noted from both FIGS. 1 and 2 that the mounting of the wheel trucks is solely on the hanger plate 11 and in no way is this mounting associated with the shoe plate 10. Only the hanger plate is connected to the shoe plate 10.

Figure 3:
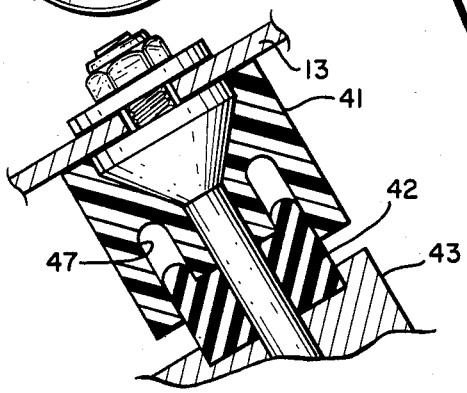

Respecting the referred to limited universal movement of the wheel truck as a consequence of the elastomer bushings 42 and 44, reference is had to the enlarged cross section of FIG. 3, wherein the first elastomer bushing 42 is shown bearing against the cushion adapter 41. It will be noted in FIG. 3 that the cushion adapter includes an annular groove 47 of a selected depth to receive some of the material of the first elastimer bushing 42. By making the groove 47 less shallow, or eliminating it completely, a greater firmness can be imparted to the support of the wheel truck 31. In other words, the firmness of the truck can be controlled by the structural characteristics of the cushion adapter 41.

Many advantages, some already mentioned, accrue from the combination shoe plate and hanger plate described herein. First, because the wheel trucks are supported solely on the hanger plate a different hanger plate with wheel trucks can be substituted for the hanger plate described onto the same shoe plate. In other words, it is not necessary for a skater to change the shoe plate and boot associated therewith in order to utilize different wheel trucks. Further, since both the front and rear wheel trucks are secured to the same integral one piece hanger plate, they will be maintained in proper alignment and the shoe plate itself properly held against twisting.

The securement of the wheel trucks by means of the kingpin and elastomer assemblies to the upwardly sloping sections 13 and 14 as described in FIGS. 1 and 2 isolates the kingpin and elastomer bushings from direct contact with the shoe plate 10.

The spacers 23 and 24 described in FIG. 1 and as already mentioned heretofore, will enable adjustment of the distance between the shoe plate 10 and the wheel trucks. Since the number of spacers can be individually adjusted for each roller skate, one of a pair of skates can include more spacers than the other to adjust the balance of a skater having one leg shorter than the other. Further, by careful selection of the spacers, a skater can shift his center of gravity to a higher or lower position. In this respect, by removing spacers to bring the wheel trucks closer to the shoe plate and by using smaller diameter wheels, the center of gravity is lowered, whereas by adding spacers and substituting larger diameter wheels, the center of gravity is raised. The former condition is oftentimes desirable for inside dancing while the latter would be preferable for outdoor use.

As also mentioned heretofore, the provision of a removable toe stop supporting plate gives a skater the option of providing a toe stop or not.

Changes falling clearly within the scope and spirit of this invention will occur to those skilled in the art. The roller skate, accordingly, is not to be thought of as limited to the exact embodiment set forth merely for illustrative purposes.

I claim:

1. A roller skate including, in combination:

(a) a shoe plate;

(b) an integral, one-piece flat, generally transversely planar hanger plate having:

1. a flat central section spaced from the underside of the shoe plate and merging into
2. front and rear upwardly sloping intermediate sections, thence into (3) front and rear flat intermediate sections, and thence terminating in (4) front and rear downwardly sloping end sections;

(c) front and rear detachable securing means connecting only said front and rear flat imtermediate sections respectively to said shoe plate, the remaining sections of said hanger plate being free of engagement with said shoe plate;

(d) front and rear wheel trucks;

(e) front and rear king pin and elastomer cushioning means connecting said front and rear wheel trucks respectively to the underside of said front and rear upwardly sloping intermediate sections of said hanger plare at a level lower than said front and rear intermediate flat sections; and (f) front and rear pivot bushing assemblies extending from said front and rear wheel trucks towards the underside of said front and rear downwardly sloping end sectons, respectively whereby said wheel turcks are supported solely on said hanger plate and a different hanger plate with wheel trucks can be substituted for said first mentioned hanger plate onto said same shoe plate and whereby said front and rear wheel trucks both being secured to the same integral plate are maintained in proper alignment and said shoe plate is isolated against the twisting of said hanger plate, and whereby said king pin and elastomer bushings are isolated from direct contact with said shoe plate as a result of mounting the same on said front and rear upwardly sloping intermediate sections below the level of said front and rear intermediate sections.

2. A roller skate according to claim 1, in which said detachable securing means includes front and rear individual spacers between the top surface of said front and rear intermediate flat sections and the underside of said shoe plate whereby the level of the shoe plate relative to the wheel trucks can be adjusted and whereby one of a pair of skates can include more spacers than the other to adjust the balance of a skater having one leg shorter than the other.

3. A roller skate according to claim 1, including a front toe stop supporting plate, said front detachable securing means functioning to secure a rear portion of said supporting plate to the front underside surface of said shoe plate, and, additional detachable means for further securing said supporting plate to said front underside surface of said shoe plate; and a toe stop mounted in said supporting plate whereby the toe stop and supporting plate can be removed from the roller skate if desired to lighten the skate and provide freedom for special types of skating activities.

4. A roller skate according to claim 1, in which each of said front and rear king pin and elastomer cushioning means includes a king pin stud bolt secured to a corresponding upwardly sloping intermediate section of said hanger plate, a cushion adapter on said stud bolt seated against the underside of said upwardly sloping intermediate section; a first elastomer bushing received about said stud bolt to seat against said cushion adapter; a truck eye axially aligned with said stud bolt and receivable against said first elastomer bushing, the diameter of said eye being greater than said stud bolt; a second elastomer bushing received about said stud bolt to sandwich said eye with said first elastomer bushing; and a nut and washer said nut being threadedly received on said stud bolt to hold the assembly together, said first and second elastomer bushings allowing a limited universal freedom of movement of said truck, said movement being stabilized by said front and rear pivot bushing assemblies.

5. A roller skate according to claim 4, in which said cushion adapter includes an annular groove of selected depth to receive some of the material of said first elastomer bushing to thereby enable the degree of firmness of said truck to be adjusted.

* * * * *